US009296093B2

(12) United States Patent
Ross

(10) Patent No.: US 9,296,093 B2
(45) Date of Patent: Mar. 29, 2016

(54) BIAS AND REVERSING MECHANISM FOR ROLLER CLUTCH RATCHET

(71) Applicant: Snap-on Incorporated, Kenosha, WI (US)

(72) Inventor: David Ross, Beach Park, IL (US)

(73) Assignee: Snap-on Inc., Kenosha, WI (US)

( * ) Notice: Subject to any disclaimer, the term of this patent is extended or adjusted under 35 U.S.C. 154(b) by 102 days.

(21) Appl. No.: 14/261,903

(22) Filed: Apr. 25, 2014

(65) Prior Publication Data

US 2015/0306745 A1 Oct. 29, 2015

(51) Int. Cl.
*B25B 13/00* (2006.01)
*B25B 13/46* (2006.01)

(52) U.S. Cl.
CPC ..... *B25B 13/462* (2013.01)

(58) Field of Classification Search
CPC .. B25B 13/465; B25B 13/462; B25B 13/461; B25B 13/46; B25B 13/06; F16D 41/088
USPC ..... 81/63.1, 62, 59.1, 58, 58.3, 58.4; 192/44, 45.001, 45.006
See application file for complete search history.

(56) References Cited

U.S. PATENT DOCUMENTS

| | | | | | |
|---|---|---|---|---|---|
| 835,448 | A | | 11/1906 | Lowry | |
| 1,511,226 | A | | 10/1924 | Lawrence | |
| 2,469,572 | A | | 5/1949 | Pratt | |
| 2,584,256 | A | * | 2/1952 | Brown | B25B 13/462 192/44 |
| 2,722,149 | A | | 11/1955 | Henley | |
| 3,398,612 | A | | 8/1968 | Batten | |
| 3,640,158 | A | | 2/1972 | Myers | |
| RE28,561 | E | | 9/1975 | Stephens | |
| 3,908,487 | A | * | 9/1975 | Plaw | B25B 15/04 192/44 |
| 4,297,924 | A | | 11/1981 | Stephens | |
| 4,408,504 | A | | 10/1983 | Dobosh | |
| 4,457,416 | A | | 7/1984 | Kutzler | |
| 4,881,018 | A | * | 11/1989 | Kato | E05F 15/619 192/21 |
| 4,987,803 | A | | 1/1991 | Chern | |
| 5,086,673 | A | | 2/1992 | Korty | |
| 5,269,207 | A | | 12/1993 | Kutzler | |
| 5,406,866 | A | * | 4/1995 | Badiali | B25B 15/02 81/57.3 |
| 5,752,590 | A | * | 5/1998 | Lin | B25B 13/462 192/44 |
| 5,941,140 | A | * | 8/1999 | Suksi | B25B 13/462 192/44 |
| 6,267,027 | B1 | | 7/2001 | Mitchell | |

(Continued)

FOREIGN PATENT DOCUMENTS

WO WO2011/103685 9/2011

OTHER PUBLICATIONS

United Kingdom Intellectual Property Office Search Report, dated Sep. 15, 2014; 4 pages.

*Primary Examiner* — Shelley Self
*Assistant Examiner* — Melanie Alexander
(74) *Attorney, Agent, or Firm* — Seyfarth Shaw LLP

(57) ABSTRACT

A roller clutch mechanism of a reversible ratchet tool is configured to include a biasing and reversing mechanism for biasing rollers in the roller clutch mechanism. A cage member of the roller clutch mechanism locates rollers in either a clockwise or counterclockwise position based on a selective position of the reverser mechanism. The reverser mechanism applies a constant bias to the cage member so that the rollers are constantly biased and quickly engage between the ratchet body and the drive head. The constant bias applied to the cage member reduces the ratcheting angle for improved performance of the reversible ratchet tool.

19 Claims, 7 Drawing Sheets

(56) References Cited

U.S. PATENT DOCUMENTS 6,993,997 B1 2/2006 Marro

2005/0120832 A1* 6/2005 Chiang ..... B25B 13/462 81/59.1

2014/0060257 A1* 3/2014 Douglass ..... B25B 13/46 81/59.1

* cited by examiner

BIAS AND REVERSING MECHANISM FOR ROLLER CLUTCH RATCHET

TECHNICAL FIELD OF THE INVENTION

The present application relates generally to a tool for applying torque to an object. More particularly, the present application relates to a roller clutch mechanism for a reversible ratchet-type tool.

BACKGROUND OF THE INVENTION

Reversible ratchet tools, such as socket wrenches and drivers, are commonly used in automotive, industrial and household applications to install and remove threaded fasteners and to apply an amount of torque and/or angular displacement to work pieces, such as a threaded fasteners, for example. Various mechanisms within ratchet tools are configured to prevent rotation of a ratchet drive head relative to the tool handle in one direction and to allow rotation of the ratchet head relative to the tool handle in the opposite direction. This allows the drive head to apply torque to a fastener through large angles by repeating smaller angular movements of the tool handle and without disengaging the tool head from the fastener after each movement. For conventional ratchet tools, the smaller angular movements on each stroke must reach at least a minimum angular displacement to overcome backlash and cumulative dimensional variations of the tool components within manufacturing tolerances. Backing the handle of a ratchet tool through some minimum angular displacement after each movement provides sufficient rotation of the ratchet body relative to a drive member to overcome the backlash and dimensional variations to configure the tool for applying a torque on a following movement.

Ratchet tools which require an excessive angular displacement of the handle may not be usable in confined spaces. It is thus desirable to reduce or eliminate the minimum angular displacement constraint, i.e., ratchet angle, of conventional ratchet tools in order to allow use of the tool in locations where angular displacements of the handle may be obstructed.

SUMMARY OF THE INVENTION

Aspects of the present application include a roller clutch mechanism of a reversible ratchet tool that reduces relative rotation between the ratchet body and a drive head. The reversible ratchet tool includes a biasing and reversing mechanism for a roller clutch. A cage member of the roller clutch mechanism locates rollers in either a clockwise or counterclockwise position based on a position of the reversing mechanism. The reverser mechanism applies a constant bias to the cage member so that the rollers are biased to quickly engage between the ratchet body and the drive head. The constant bias applied to the cage member reduces the ratcheting angle for improved performance of the reversible ratchet tool.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

Figure 1A:
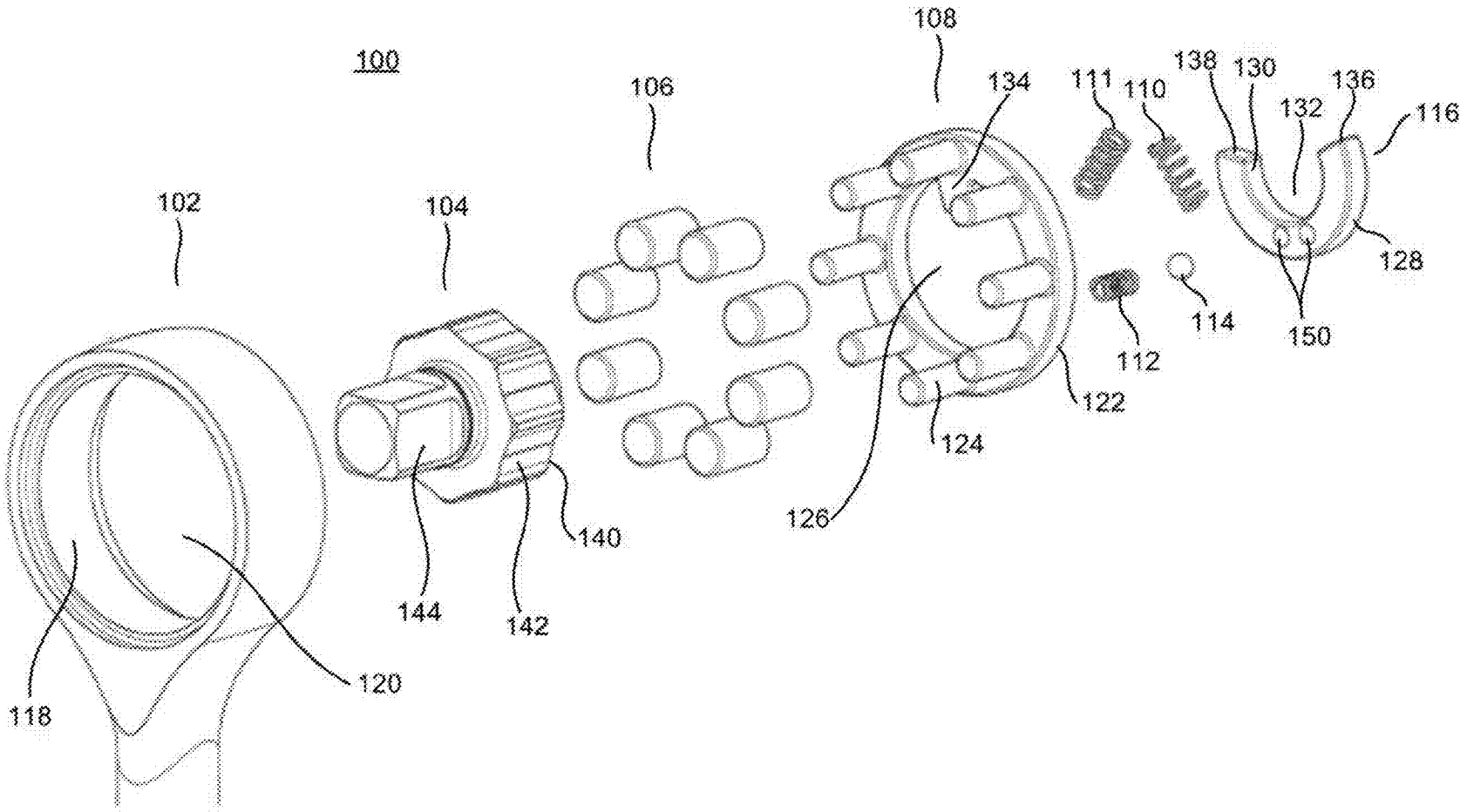
FIG. 1A is a front, perspective exploded view illustrating a reversible ratchet apparatus in accordance with an embodiment of the present application.

It should be understood that the comments included in the notes as well as the materials, dimensions and tolerances discussed therein are simply proposals such that one skilled in the art would be able to modify the proposals within the scope of the present application.

DETAILED DESCRIPTION OF THE EMBODIMENTS

While this invention is susceptible of embodiments in many different forms, there is shown in the drawings, and will herein be described in detail, a preferred embodiment of the invention with the understanding that the present application is to be considered as an exemplification of the principles of the invention and is not intended to limit the broad aspect of the invention to embodiments illustrated.

An illustrative embodiment of a reversible ratchet tool according to aspects of the present disclosure is described with reference to FIGS. 1A and 1B. In an embodiment, a reversible ratchet tool 100 includes a ratchet body 102, a cage member 108 sized to fit and disposed within the ratchet body 102, a reverser sleeve 116 sized to fit coaxially disposed within the cage member 108, and a drive member 104 including an axle portion 105 sized to be rotatably contained by the reverser sleeve 116. A number of rollers 106 are constrained by the cage member 108 between an inner surface 118 of the ratchet body 102 and the drive member 104. According to an aspect of the present disclosure, the drive member 104 and the reverser sleeve 116 are selectively constrained in either of a first angular displacement or a second angular displacement relative to each other. At least one biasing member 110 is configured to exert a substantially continuous rotational biasing force between the reverser sleeve 116 and the cage member 108.

Figure 1B:
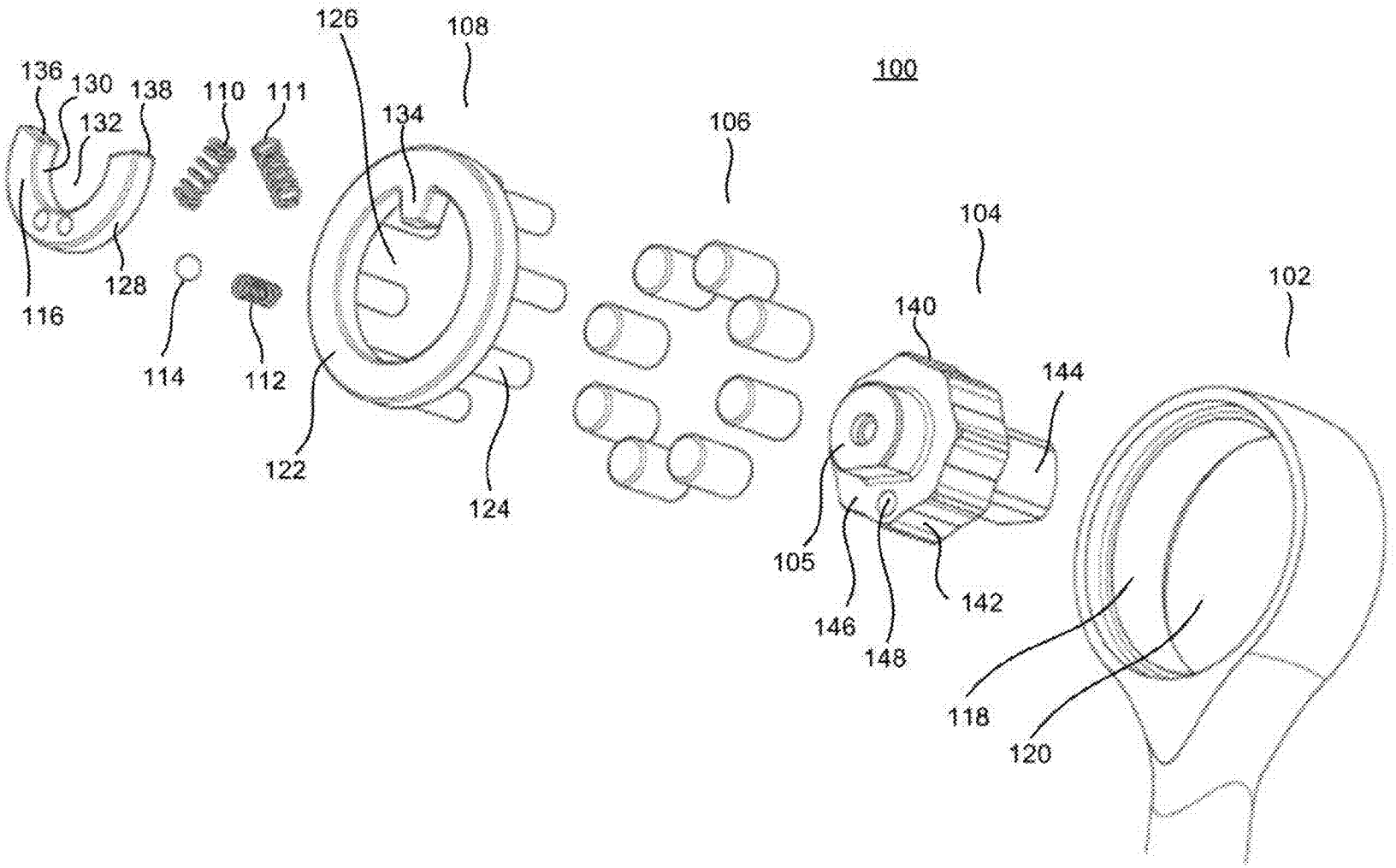
FIG. 1B is a rear, perspective exploded view illustrating a reversible ratchet apparatus in accordance with an embodiment of the present application.

In one example, the biasing member 110 may consist of a pair of compression springs 110, 111 as shown in FIGS. 1A and 1B. According to an aspect of the present disclosure, the cage member 108 is configured to shift the rollers 106 from a corresponding first position on the drive member 104 to a corresponding second position on the drive member 104 when an angular displacement between the drive member 104 and the reverser sleeve 116 is shifted from the first angular displacement to the second angular displacement. A reverser lever (not shown) may be coupled to the reverser sleeve 116 or may be formed together with the reverser sleeve 116 as a single component, for example.

The rollers 106 are cylindrically shaped and sized to selectively prevent relative motion between the ratchet body 102 and the drive member 104 only in a first direction of rotation when the rollers are in their corresponding first positions, and to prevent relative motion between the ratchet body 102 and the drive member 104 only in a second direction of rotation opposite the first direction of rotation when the at rollers are in the corresponding second positions.

According to aspects of the present disclosure, the ratchet body 102 includes an inner surface 118 defining an inner wall of a circular aperture 120. In the illustrative embodiment, the cage member 108 includes an annular base 122 and a plurality of axial fingers 124 extending from one side of the annular base 122. The annular base 122 is sized to fit and be coaxially disposed within the circular aperture 120, wherein the fingers 124 substantially avoids contact with the inner surface 118, to cooperatively define a cage aperture 126. In this embodiment, a tab 134 extends radially from the annular base into the cage aperture 126.

In an illustrative embodiment, the reverser sleeve 116 is a semi-annular reverser sleeve including an outer semi-annular wall 128 sized to fit coaxially within the cage aperture 126 and including an inner semi-annular wall 130 defining a first portion of a central aperture 132. The reverser tab 134 defines a second portion of the central aperture 132 having a same diameter as the first portion of the central aperture 132. In one example, according to an aspect of the present disclosure, the semi-annular reverser sleeve 116 includes a first end 136 and a second end 138. A first biasing member 110 is engaged between the first end 136 and the tab 134. A second biasing member 111 is engaged between the second end 138 and the tab 134.

In the illustrative embodiment, the drive member 104 includes the axle portion 105 sized to be rotatably contained by the central aperture 132 and a drive body coaxial with the axle portion. According to an aspect of the present disclosure, the drive body 140 includes a scalloped outer surface 142. The drive member 104 may also include a drive lug 144 extending from the drive body 104 and coaxial with the axle portion 105. In one example, the drive lug 144 may be configured as a square socket drive. In other embodiments, the drive lug 144 may be any of various commonly known ratchet drive configurations, such as a screw driver head, for example. Other embodiments may be configured with a drill chuck, box end wrench head or a socket in place of the drive shaft 144, for example, without departing from the scope and spirit of the present application.

According to an aspect of the present disclosure, at least one engagement member is engaged between the drive member 104 and the reverser sleeve 116. The engagement member is configured to constrain the drive member 104 and the reverser sleeve 116 in either of a first angular displacement or a second angular displacement relative to each other. For example, in the illustrative embodiment, the drive member 104 includes a shoulder 146 (see FIG. 1B) facing the reverser sleeve 116. The shoulder 146 includes a pocket 148 sized to retain a detent spring 112. The reverser sleeve 116 includes at least two detent cavities 150 facing the shoulder 146 and angularly displaced from each other. The engagement member consists of a detent ball 114 sized to fit in either one of the detent cavities 150 and the detent spring 112. The detent spring 112 is at least partially retained in the pocket 148 and compressed between the detent ball 114 and the drive member 104.

Figure 2:
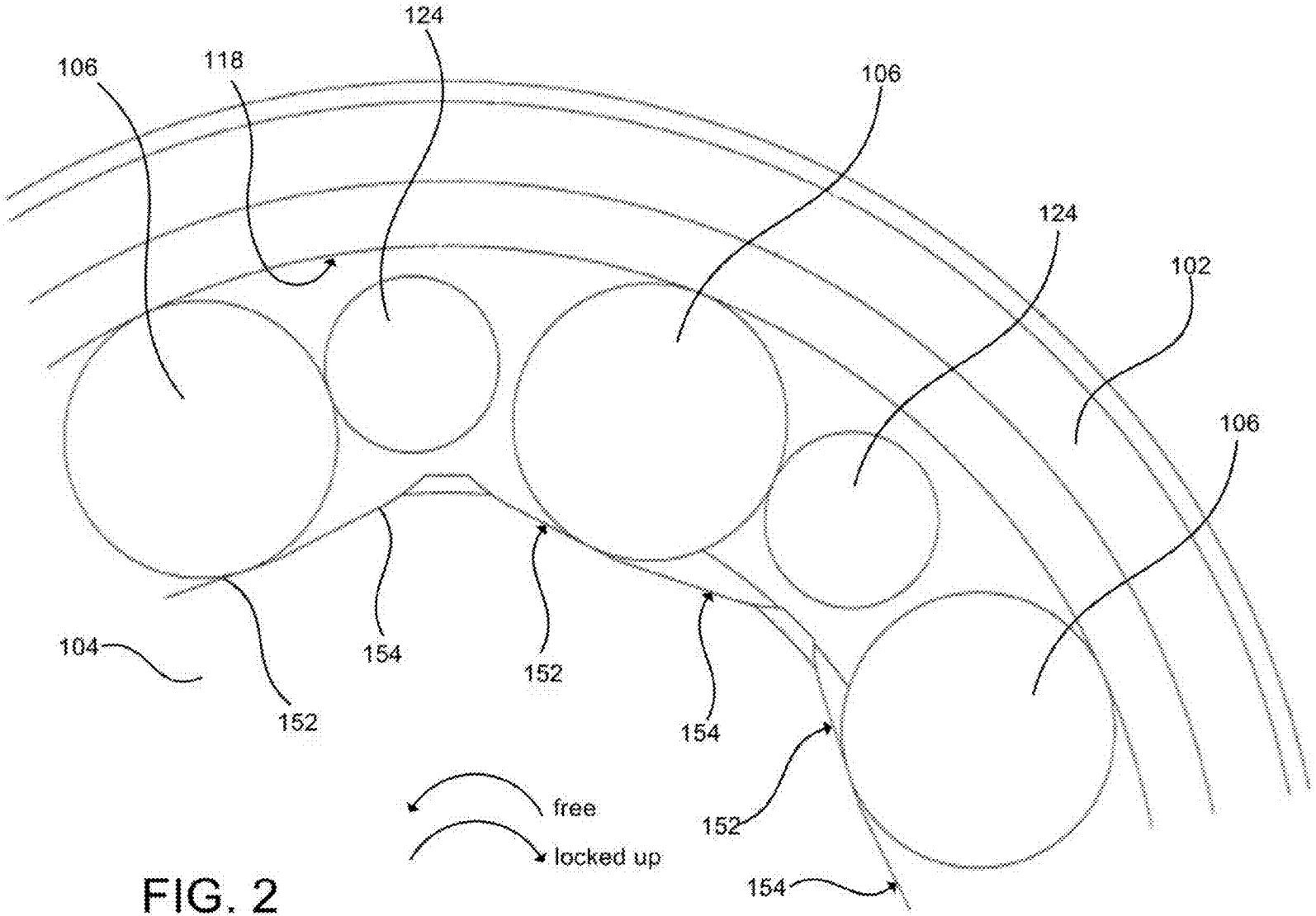
FIG. 2 is an enlarged plan view illustrating rollers binding between a drive member an a ratchet body according to an aspect of the present application.

Engagement between the ratchet body 102, the rollers 106 and the drive member 102 is described with reference to FIG. 2. In order for the ratchet tool 100 to apply a torque from the ratchet body 102 to the drive member 104, the rollers 106 are frictionally wedged between the inner surface 118 of the circular aperture 120. In the arrangement shown in FIG. 2, the drive member 104 is allowed to freely rotate counter-clockwise with respect to the ratchet body 102, but locks-up when rotated in a clockwise direction with respect to the ratchet body 102, thus imparting torque from the ratchet body 102.

According to aspects of the present disclosure, the rollers 106 are each constrained between a corresponding pair of fingers 124 of the cage member 108. The rollers 106 are also constrained between the inner surface 118 of the circular aperture 120 and the scalloped surface 142 of the drive member 104. The fingers 124 are configured to shift the rollers 106 from a corresponding first ramp 152 on the scalloped surface to a corresponding second ramp 154 on the scalloped surface when an angular displacement between the drive member 104 and the semi-annular reverser sleeve 116 is shifted from the first angular displacement to the second angular displacement. The fingers 124 of the cage member 108 keep each roller 106 in contact with the inner surface 118 and with either the corresponding first ramp 152 or the corresponding second ramp 154.

According to an aspect of the present disclosure, the rollers 106 are sized to respectively bind between the first ramps 152 and the inner surface 118 of the ratchet body 102 to prevent relative motion between the ratchet body 102 and the drive member 104 only in a first direction of rotation when the rollers 106 respectively engage and bind the corresponding first ramps 152, and to respectively bind between the second ramps 154 and the inner surface 118 of the ratchet body 102 to prevent relative motion between the ratchet body 102 and the drive member 104 only in a second direction of rotation opposite the first direction of rotation when the rollers 106 respectively engage and bind the corresponding second ramp 154.

To reverse the free-spinning and driving directions of the roller clutch mechanism in the reversible ratchet tool 100, the cage member 108 is rotated clockwise with respect to the drive member 104 so fingers 124 keep the rollers 106 in contact with the inner surface 118 of the ratchet body 102 and the second ramp 154.

Figure 3A:
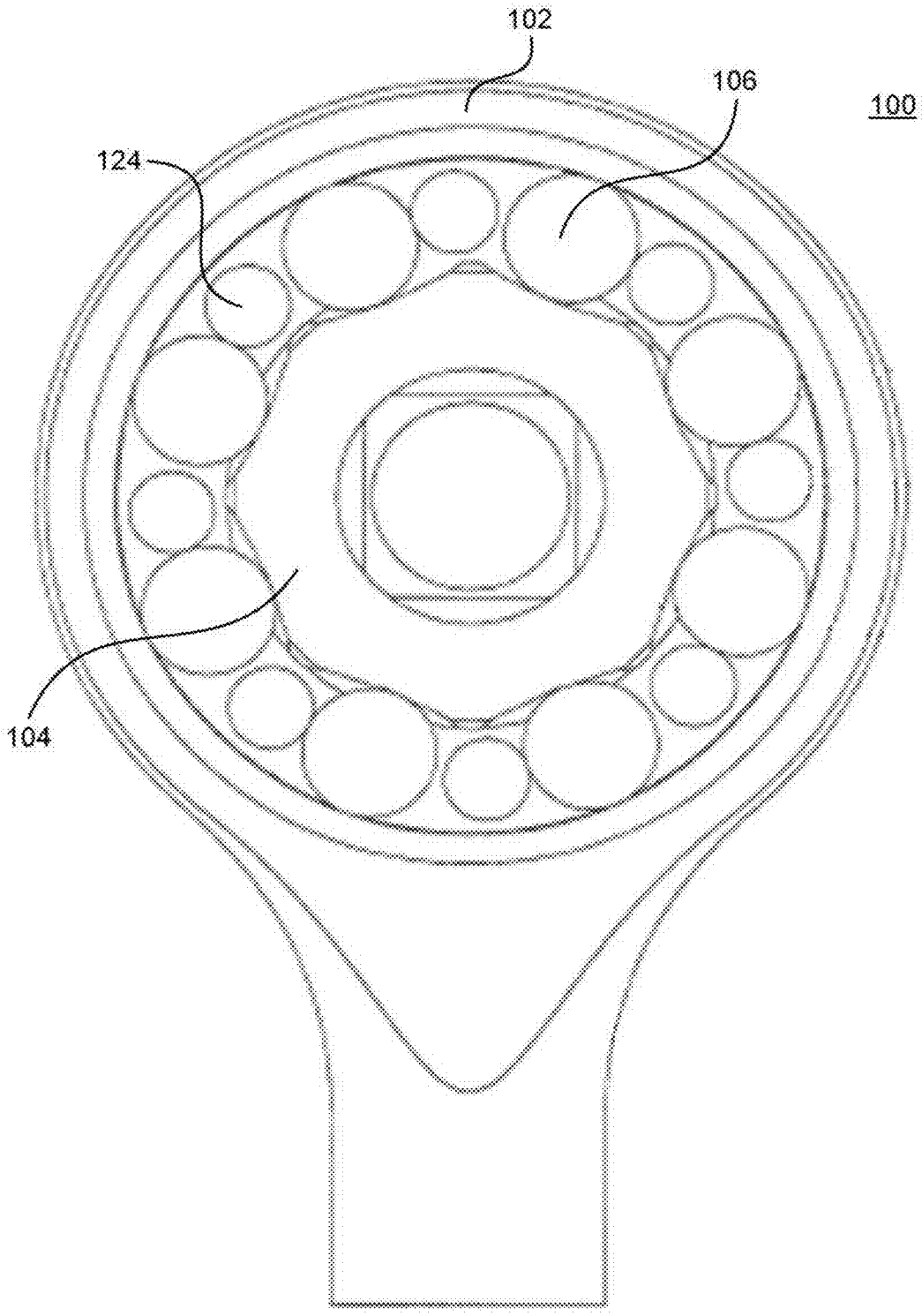
FIG. 3A is a plan view of a reversible ratchet apparatus configured to apply torque in a first direction according to an aspect of the present disclosure.

FIG. 3A is an illustration of a reversible ratchet apparatus 100 configured to apply torque in a first direction according to an aspect of the present disclosure. As shown in FIG. 3A, the drive member 104 is prevented from rotating clockwise with respect to the ratchet body 102. Thus, torque may be transmitted from the ratchet body 102 to the drive member 104 by counterclockwise motion of the ratchet body.

Figure 3B:
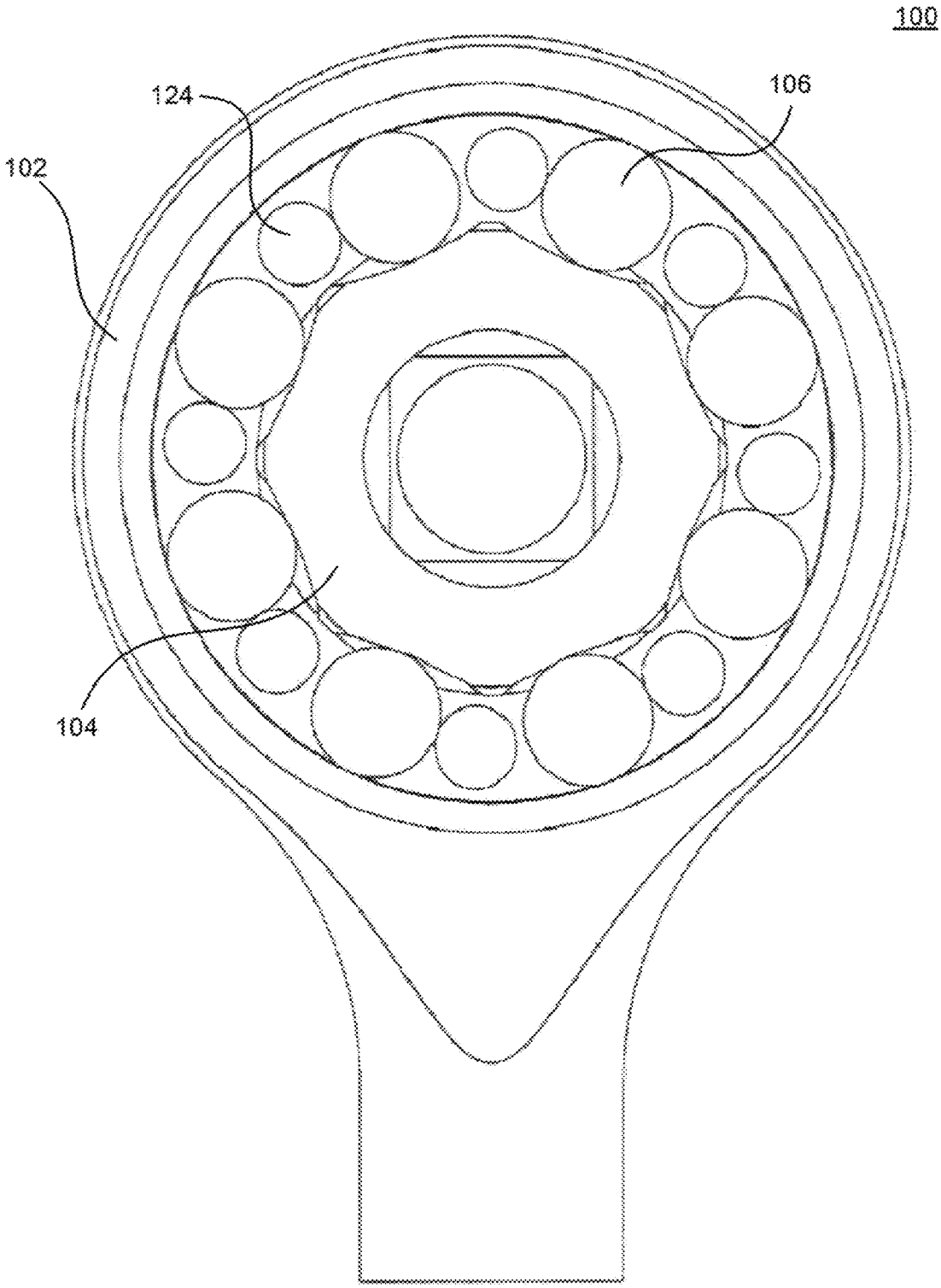
FIG. 3B is a plan view of the reversible ratchet apparatus of FIG. 3A configured to apply torque in a second direction according to an aspect of the present disclosure.

FIG. 3B is an illustration of a reversible ratchet apparatus 100 configured to apply torque in a second direction according to an aspect of the present disclosure. As shown in FIG. 3B, the drive member 104 is prevented from rotating counterclockwise with respect to the ratchet body 102. Thus, torque may be transmitted from the ratchet body 102 to the drive member 104 by clockwise motion of the ratchet body.

Figure 4:
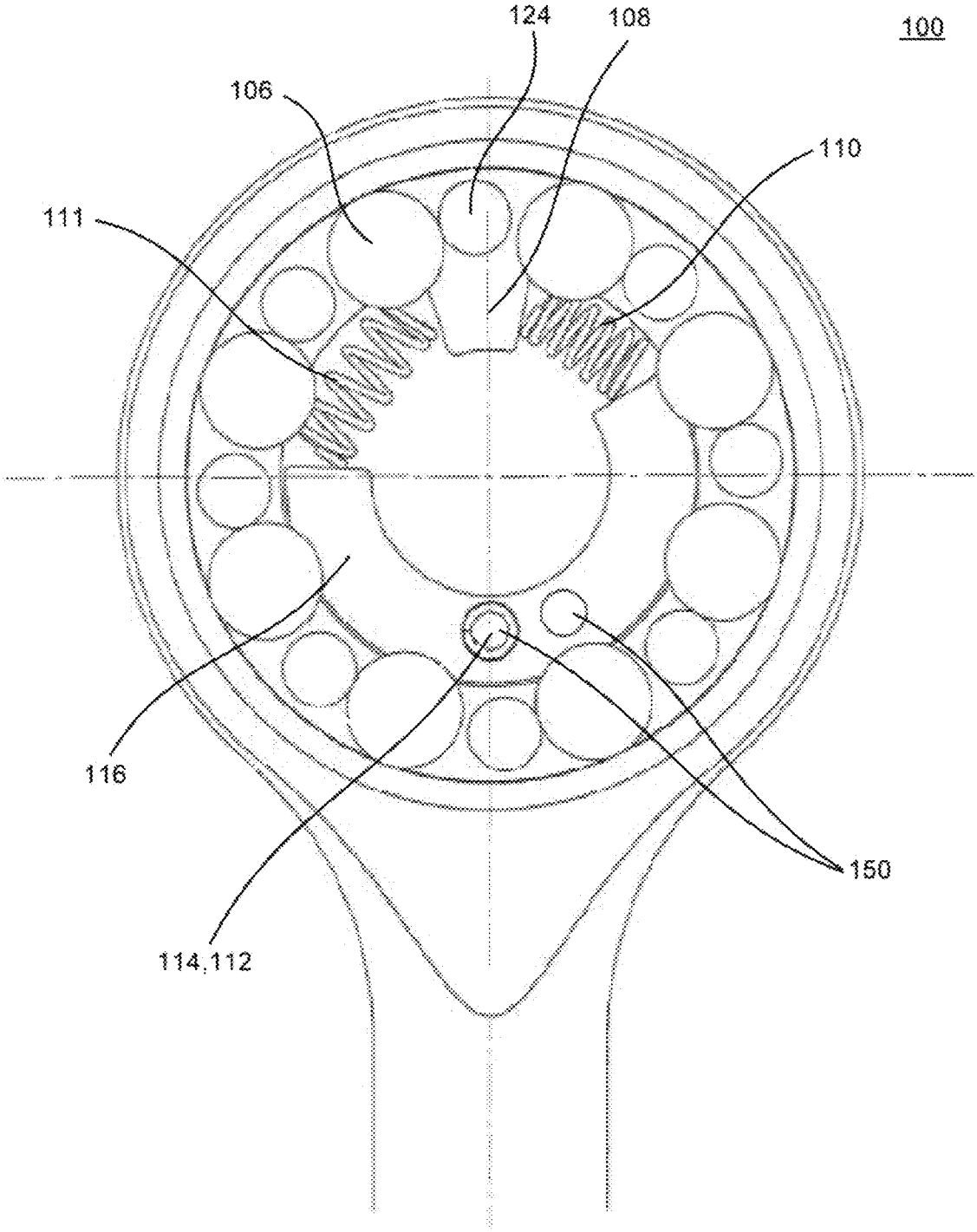
FIG. 4 is a plan view of biasing members engaged between a reverser sleeve and a cage member in a reversible ratchet apparatus according to aspects of the present disclosure.

FIG. 4 is an illustration of the reversible ratchet apparatus 100 showing biasing members 110, 111 engaged between a reverser sleeve 116 and a cage member 108 according to aspects of the present disclosure. In FIG. 4, the drive member 104 is hidden for clarity. Although a reverse lever could be coupled in direct contact with the cage member 108 to facilitate selectively switching between the two cage positions, normal manufacturing tolerances would lead to a "sloppy" action with an unacceptable amount of handle travel between ratcheting strokes. In the disclosed embodiments, a bias member 110, 111, such as a spring, is configured to provide a continuous rotational bias between the reverser sleeve 116 and cage member 108. The reverser sleeve 116 may be selectively engaged in one of two detent positions defined by the detent ball 114 and detent spring 112 being disposed in either of the two detent cavities 150 in the reverser sleeve 116. The biasing members 111, 110 push against the reverser sleeve 116 and cage member 108 to provide positive pressure between fingers 124 of the cage member 108 and rollers 106. This reduces or minimizes excessive free movement or "slop" in the ratcheting action.

Figure 5:
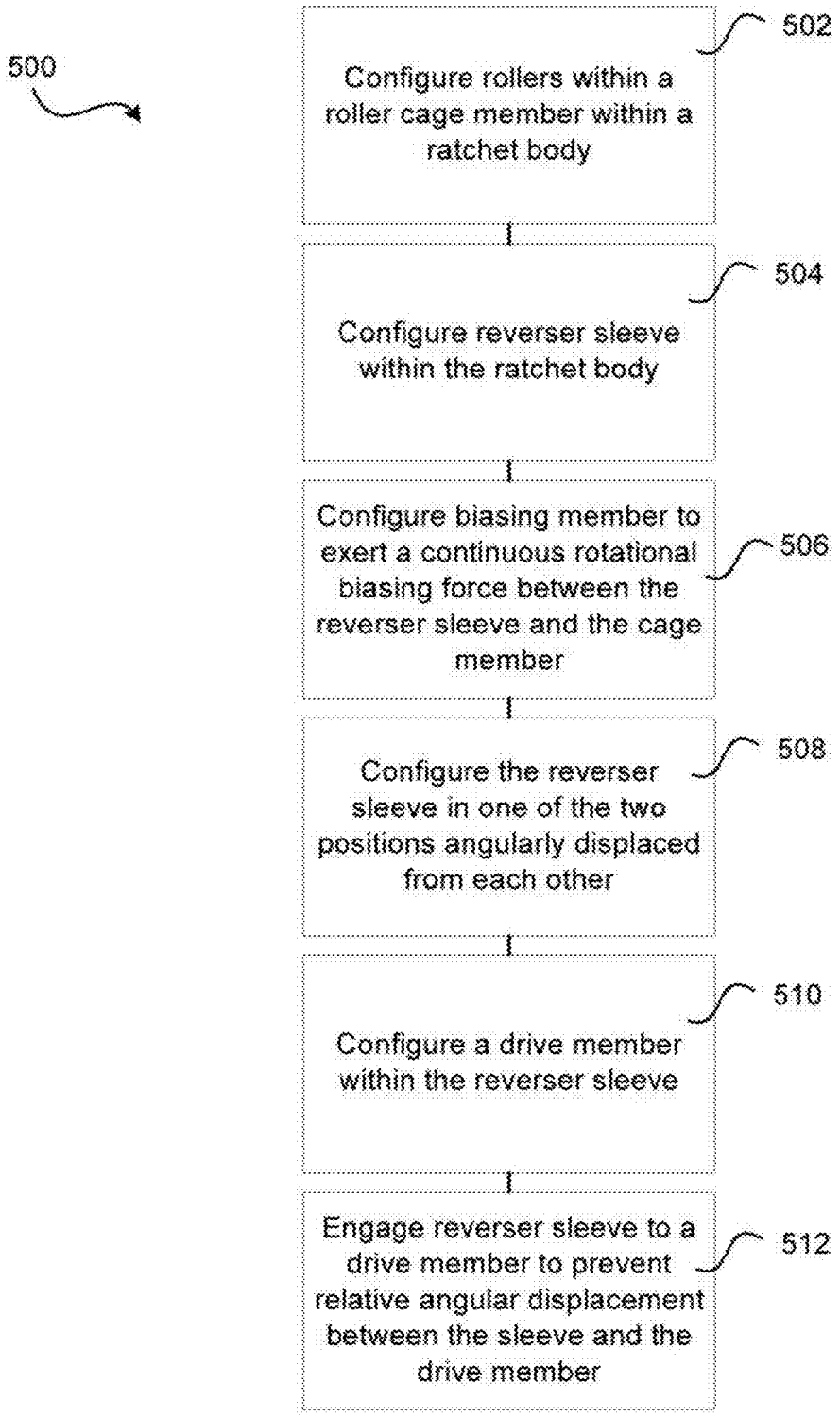
FIG. 5 is a flow chart depicting a method of configuring a ratchet drive according to aspects of the present disclosure.

Another aspect of the present disclosure includes a method for reducing backlash in a reversible ratchet tool. Referring to FIG. 5, in block 502, the method includes configuring a circular array of rollers within a circular roller cage member for rotation around an axis within a ratchet body. In block 504, the method includes configuring a semi-annular reverser sleeve within the ratchet body for rotation around the axis. In block 506, the method includes configuring at least one biasing member to exert a continuous rotational biasing force between the reverser sleeve and the cage member and about the axis. At block 508, the method includes configuring the semi-annular reverser sleeve in one of two positions angularly displaced from each other about the axis. At block 510, the method includes configuring a drive member within the reverser sleeve for rotation about the axis. At block 512, the method includes engaging the semi-annular reverser sleeve to a drive member to prevent relative angular displacement between the semi-annular reverser sleeve and the drive member.

As used herein, the term "coupled" or "communicably coupled" can mean any physical, electrical, magnetic, or other connection, either direct or indirect, between two parties. The term "coupled" is not limited to a fixed direct coupling between two entities.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A reversible ratchet apparatus, comprising:

a ratchet body including an inner surface defining a circular aperture;

a cage member disposed within the ratchet body and including:

an annular base disposed within the circular aperture and cooperatively defining a cage aperture;

fingers axially extending from the annular base; and a radial tab extending from the annular base into the cage aperture;

a reverser sleeve disposed within the cage member;

a drive member including an axle portion adapted to be retained by the reverser sleeve;

a roller retained by the cage member between the ratchet body and the drive member; and a biasing member adapted to exert a biasing force between the reverser sleeve and the cage member;

wherein the drive member and the reverser sleeve are disposed in either of first or second displacements relative to each other.

2. The apparatus of claim 1, wherein the biasing member includes a compression spring.

3. The apparatus of claim 1, wherein the cage member is adapted to shift the roller from a first position to a second position on the drive member when the drive member and the reverser sleeve are shifted from the first displacement to the second displacement.

4. The apparatus of claim 3, wherein the roller is sized to substantially reduce relative motion between the ratchet body and the drive member only in a first direction of rotation when the roller is in the first position, and to substantially reduce relative motion between the ratchet body and the drive member only in a second direction of rotation opposite the first direction of rotation when the roller is in the second position.

5. The apparatus of claim 1, wherein the reverser sleeve is annularly shaped and includes an outer wall disposed within the cage aperture and an inner wall defining a first portion of a central aperture.

6. The apparatus of claim 5, wherein the radial tab defines a second portion of the central aperture having a same diameter as the first portion of the central aperture.

7. The apparatus of claim 6, wherein the reverser sleeve includes first and second ends, wherein a first biasing member is engaged between the first end and the radial tab, and a second biasing member is engaged between the second end and the radial tab.

8. The apparatus of claim 1, wherein the drive member includes a drive body coaxial with the axle portion, the drive body includes a scalloped outer surface.

9. The apparatus of claim 8, wherein the drive member further includes a drive lug extending from the drive body coaxial with the axle portion.

10. The apparatus of claim 9, wherein the drive lug forms a square socket drive.

11. The apparatus of claim 8, wherein the roller is retained between a plurality of the fingers between the inner surface of the ratchet body and the scalloped surface of the drive body.

12. The apparatus of claim 11, further comprising an engagement member engaged between the drive member and the reverser sleeve, the engagement member adapted to retain the drive member and the reverser sleeve in either of the first or second displacements.

13. The apparatus of claim 12, wherein the drive member includes a shoulder facing the reverser sleeve, the shoulder including a pocket adapted to retain a detent spring, wherein the reverser sleeve includes two detent cavities facing the shoulder and displaced from each other;

the engagement member includes a detent ball sized to fit in either one of the detent cavities and the detent spring is at least partially retained in the pocket and compressed between the detent ball and the drive member.

14. The apparatus of claim 12, wherein the fingers are adapted to shift the roller from a corresponding first ramp on the scalloped surface to a corresponding second ramp on the scalloped surface when an angular displacement between the drive member and the semi-annular reverser sleeve is shifted from the first displacement to the second displacement.

15. The apparatus of claim 14, wherein the roller is adapted to bind between the first ramp and the inner surface of the ratchet body to prevent relative motion between the ratchet body and the drive member only in a first direction when the roller is on the corresponding first ramp, and to bind between the second ramp and the inner surface of the ratchet body to prevent relative motion between the ratchet body and the drive member only in a second direction opposite the first direction when the roller is on the corresponding second ramp.

16. The apparatus of claim 1, further comprising a reverser lever coupled to the reverser sleeve.

17. A reversible ratchet apparatus, comprising:

a ratchet body including an inner surface defining an inner wall of a circular aperture;

a cage member including an annular base, a plurality of fingers extending axially from a side of the annular base, the annular base disposed within the circular aperture to cooperatively define a cage aperture, and a radial tab extending from the annular base into the cage aperture;

a semi-annular reverser sleeve including an outer semi-annular wall sized to fit coaxially within the cage aperture and an inner semi-annular wall defining a first portion of a central aperture;

a drive member including an axle portion rotatably contained by the central aperture, a drive body coaxial with the axle portion, and a drive shaft extending from the drive body coaxial with the axle portion, the drive body including a scalloped outer surface;

rollers respectively constrained between a corresponding pair of the fingers between the inner surface of the ratchet body and the scalloped surface of the drive body;

an engagement member engaged between the drive member and the semi-annular reverser sleeve, the engagement member configured to constrain the drive member and the semi-annular reverser sleeve in either of first or second angular displacements relative to each other;

a biasing member disposed between the semi-annular reverser sleeve and the radial tab, the biasing member configured to exert a continuous rotational biasing force between the reverser sleeve and the cage member;

wherein the fingers are configured to shift the rollers from respective corresponding first ramps on the scalloped surface to corresponding second ramps on the scalloped surface when an angular displacement between the drive member and the semi-annular reverser sleeve is shifted from the first angular displacement to the second angular displacement, and wherein the rollers are sized to respectively bind between the first ramps and the inner surface of the ratchet body to prevent relative motion between the ratchet body and the drive member only in a first direction of rotation when the rollers respectively engage the corresponding first ramps, and to respectively bind between the second ramps and the inner surface of the ratchet body to prevent relative motion between the ratchet body and the drive member only in a second direction of rotation opposite the first direction of rotation when the rollers respectively engage the corresponding second ramps.

18. A method for reducing backlash in a reversible ratchet tool, the method comprising:

configuring a circular array of rollers within a circular roller cage member for rotation around an axis within a ratchet body;

configuring a semi-annular reverser sleeve within the ratchet body for rotation around the axis; and configuring a biasing member to exert a continuous rotational biasing force between the reverser sleeve and the cage member and about the axis.

19. The method of claim 18, further comprising:

configuring the semi-annular reverser sleeve in one of two positions angularly displaced from each other about the axis;

configuring a drive member within the reverser sleeve for rotation about the axis; and engaging the semi-annular reverser sleeve to a drive member to prevent relative angular displacement between the semi-annular reverser sleeve and the drive member.

* * * * *